US007971775B2

(12) United States Patent
Saltsov et al.

(10) Patent No.: US 7,971,775 B2
(45) Date of Patent: Jul. 5, 2011

(54) MAGNETIC LOCK FOR BANKNOTE CASSETTE

(75) Inventors: Leon Saltsov, Thornhill (CA); Mykhaylo Kucherenko, Thornhill (CA); Pavel Rabinovich, Richmond Hill (CA); Andriy Kyselov, Thornhill (CA); Oleksandr Onipchenko, Thornhill (CA)

(73) Assignee: Crane Canada Co., Concord, ON (CA)

( * ) Notice: Subject to any disclaimer, the term of this patent is extended or adjusted under 35 U.S.C. 154(b) by 321 days.

(21) Appl. No.: 11/990,596

(22) PCT Filed: Aug. 17, 2006

(86) PCT No.: PCT/CA2006/001347

§ 371 (c)(1),
(2), (4) Date: Mar. 23, 2009

(87) PCT Pub. No.: WO2007/019695

PCT Pub. Date: Feb. 22, 2007

(65) Prior Publication Data

US 2009/0212100 A1 Aug. 27, 2009

(30) Foreign Application Priority Data

Aug. 19, 2005 (CA) ..... 2516566

(51) Int. Cl.
*G07B 15/00* (2006.01)

(52) U.S. Cl. ..... 232/15; 232/16; 194/350; 109/45; 109/52

(58) Field of Classification Search ..... 232/15, 232/16, 1 D; 194/350; 109/45, 47, 52
See application file for complete search history.

(56) References Cited

U.S. PATENT DOCUMENTS

| | | | | | |
|---|---|---|---|---|---|
| 4,283,097 | A * | 8/1981 | Lundblad | 109/52 |
| 4,337,393 | A * | 6/1982 | Hilton | 235/487 |
| 4,798,316 | A * | 1/1989 | Martin et al. | 232/43.1 |
| 4,816,652 | A * | 3/1989 | Wildgoose et al. | 235/379 |
| 4,890,766 | A * | 1/1990 | Martin et al. | 221/198 |
| 5,071,032 | A * | 12/1991 | Thornton et al. | 221/154 |
| 7,172,111 | B2 * | 2/2007 | Yoshioka et al. | 232/15 |

* cited by examiner

*Primary Examiner* — William L. Miller

(57) ABSTRACT

A cost effective latch and alignment mechanism for a banknote cassette and a cassette receiving frame uses a magnetic latch providing a magnetic force cooperating with the cassette to move it to and be releasably maintained in a final aligned position. Preferably a permanent magnet attached to the cassette receiving frame cooperates with the metal of the cassette to provide the magnetic bias and locking force.

5 Claims, 2 Drawing Sheets

MAGNETIC LOCK FOR BANKNOTE CASSETTE

FIELD OF THE INVENTION

The present invention is directed to a convenient structure for properly inserting a banknote cassette in a banknote acceptor.

BACKGROUND OF THE INVENTION

Banknote acceptors are becoming more common and typically include a removable banknote cassette which receives and temporarily stores received banknotes.

Banknote cassettes are designed to be removably retained within a banknote acceptor to allow service personnel to exchange one banknote cassette with an empty banknote cassette. Typically, the banknote cassettes are locked and various security arrangements are provided.

Many banknote cassettes include a spring loaded mechanical latch that cooperates with receiving frame for engaging and retaining the banknote cassette in the device. Typically, there is a press actuator or other manual trigger arrangement for releasing the latch to allow withdrawal of the cassette.

Mechanical latch arrangements operate satisfactorily, however, the latch requires a number of moving components and a spring arrangement for biasing the latch to the engaged position. Also, a user servicing the device must manually release the latch to allow withdrawal of the banknote cassette. This manual release is not always convenient.

The present invention seeks to overcome a number of these disadvantages and provide a cost effective latch arrangement for a banknote cassette.

SUMMARY OF THE INVENTION

The present invention is directed to a banknote cassette and a cassette receiving frame in combination. The banknote cassette includes a closed generally rectangular container removably received in the cassette receiving frame in an aligned position for receiving banknotes through a receiving slot provided in the banknote receiving cassette.

The cassette receiving frame includes a guide for slidably receiving the cassette for movement to a stop position determining the aligned position. A magnetic latch is formed between the cassette receiving frame and the banknote cassette providing a manually breakable magnetic force maintaining the cassette in the aligned position and allowing the user to break the magnetic force by withdrawing the banknote cassette.

In an aspect of the invention, the magnetic latch provides sufficient force to move the cassette to an aligned position when approximately received in the cassette receiving frame. The magnetic force is sufficient to move the cassette to the final aligned position.

In a different aspect of the invention, the magnetic latch is defined by a permanent magnet and a magnetic material with the permanent magnet secured to one of the banknote cassette or the cassette receiving frame, and cooperating with the magnetic material provided as part of a surface of the banknote cassette or cassette receiving frame opposed to the permanent magnet.

In a further aspect of the invention, the permanent magnet is part of the cassette receiving frame.

In yet a further aspect of the invention, the magnetic material is part of a metal wall of the banknote cassette engaged by the permanent magnet when the banknote cassette is inserted in the cassette receiving frame.

In yet a further aspect of the invention, the permanent magnet is positioned to attract a central portion on a rear surface of the banknote cassette.

In a further aspect of the invention, spacer members are provided on opposite sides of the permanent magnet which extend beyond the permanent magnet to contact the banknote cassette and space the banknote cassette a predetermined distance from the permanent magnet to thereby limit the magnetic force and determine a final aligned position.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
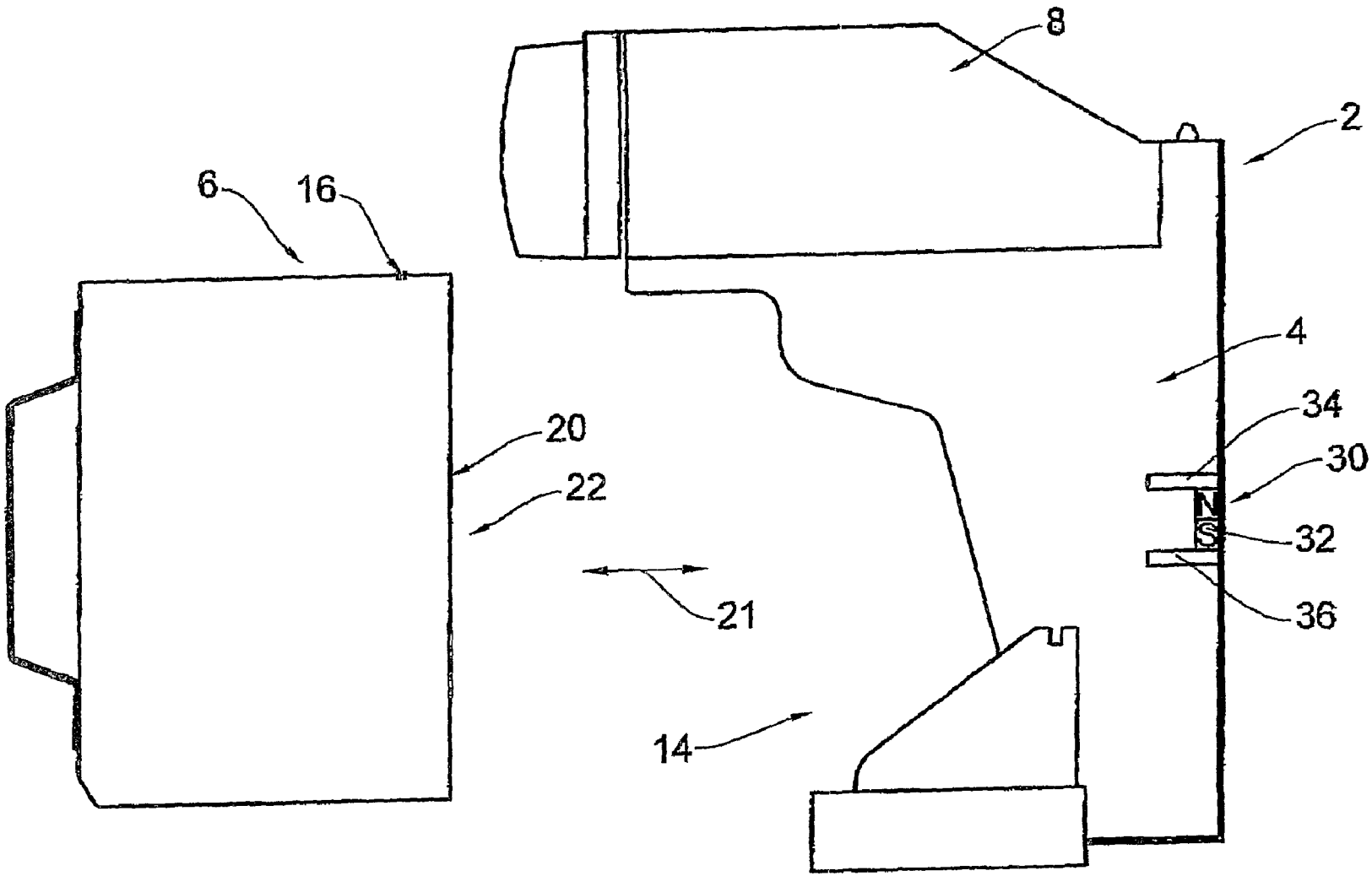
FIG. 1 is a side view illustrating a banknote acceptor having a removable banknote cassette and a banknote cassette receiving frame.
Figure 2:
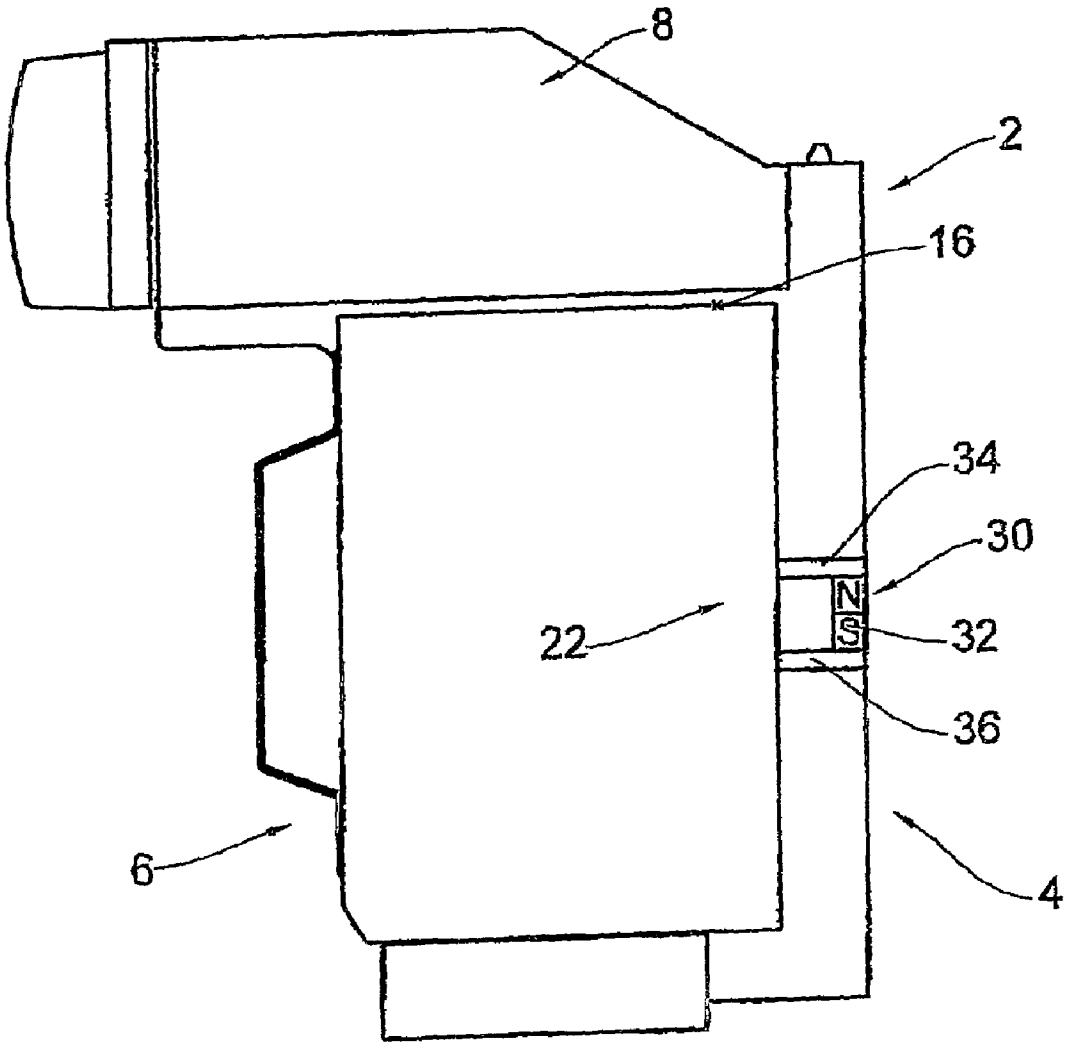
FIG. 2 is a side view of the banknote validator with the cassette received in the banknote receiving frame in an aligned final position.

The banknote acceptor 2 shown in FIGS. 1 and 2 includes a validator 8 which receives and processes banknotes or other forms of substrate payment. If the banknote is determined to be valid and acceptable for payment, it is passed through the validator and provided to the removable banknote cassette 6. The banknote cassette 6 is received and retained within the cassette receiving frame 4 in a final aligned position.

The banknote cassette 6 is of a generally rectangular shape and includes a banknote receiving slot 16. Typically banknotes are fed through the banknote receiving slots 16 and are temporarily positioned in a receiving compartment. The banknote cassette typically includes a stacking mechanism to displace a received banknote from the initial received compartment into a banknote storage compartment provided to one side of the receiving compartment. Thus, it can be appreciated that the banknote cassette can include mechanical arrangements for further processing of a validated banknote for appropriate storage in the cassette. Part of a mechanical drive force stacking mechanism is often provided on an exterior wall of the cassette.

Cassettes traditionally have been made of a fabricated metal assembly with a lockable door at one end thereof. Typically, the cassette is made of a steel sheet material. More recently, high strength plastic materials have been proposed for use with the removable cassette. It is also known to use a two piece plastic cassette.

In FIG. 1, the banknote cassette 6 is shown in a released position and is insertable and latchable with the cassette receiving frame 4. The cassette receiving frame includes an opening 14 including guides that cooperate with the sides of the banknote cassette 6. The cassette is movable to engage the frame 4 and/or be removed from the frame 4 as indicated by the arrow 21. The rear wall 20 of the banknote cassette 6 is often made of a metal magnetic material such as steel, and as such, will be attracted by the permanent magnet 32 provided in opposed relation on the cassette receiving frame 4. Spacers 34 and 36 are provided either side of the permanent magnetic 32 and form a stop surface for the rear wall 20 of the cassette 4. When the cassette is initially inserted into the cassette receiving frame, the user merely pushes the cassette into the frame. If there is any slight misalignment or failure to push the cassette entirely into the cassette receiving frame 4, the permanent magnet 32 will provide sufficient force to draw the cassette into the final aligned position as shown in FIG. 2. The spacers 34 and 36 space the magnetic material provided on the rear wall 20 a short distance from the permanent magnet. These spacers provide a simple way for controlling the extent of the magnetic force.

As previously mentioned, some banknote cassettes are now being made of a plastic material. In this case, a portion of the rear wall 20 can include the magnetic material 22 as an insert or as an additional surface of the rear wall.

The magnetic latch as generally described above provides a convenient and effective mechanism for a user to properly insert a cassette into the cassette receiving frame and move the banknote cassette to a final aligned position as long as the cassette is generally inserted within the frame. It is also convenient for a user to remove the cassette merely by pulling on the handle 40 and overcoming the magnetic force between the permanent magnet 32 and the magnetic material 22 of the rear wall 20.

The spacers 34 and 36 are provided to allow the permanent magnet 32 to be relatively strong while reducing the effective magnetic force by assuring a certain amount of spacing between the permanent magnet 32 and the magnetic material 22. In this way, the magnetic force will not be that high to create any problem for a user to remove the cassette.

With the arrangement as shown in the drawings, the magnetic latch 30 created by the permanent magnet 32 and the magnetic material 22 effectively uses the material of the cassette to form part of the latch and/or allows a inexpensive magnetic material insert to be added to the cassette. Therefore the latch cost for the cassette is low. The banknote acceptor and the cassette receiving frame 4 include the permanent magnet, and as such, have slightly higher cost. This arrangement is preferred as a banknote acceptor 2 may have several cassettes which are used with the device. Similarly, the owner of many banknote acceptors will typically have at least double the number of banknote cassettes.

It has been found that this magnetic latch is convenient and provides effective alignment of the cassette with the cassette receiving frame. This is important as typically there can be one or more drive arrangements which connect certain motors of the acceptor with gears within the banknote cassette and/or there could be information exchange connections and there is also the need to properly align the banknote slot 16 with the appropriate position of the output of the validator 8.

Although various preferred embodiments of the present invention have been described herein in detail, it will be appreciated by those skilled in the art, that variations may be made thereto without departing from the spirit of the invention or the scope of the appended claims.

The embodiments of the invention on which an exclusive Property or privilege is claimed are defined as follows:

1. In combination a banknote cassette and a cassette receiving frame, said banknote cassette including a closed generally rectangular container removably received in said cassette receiving frame in an aligned position for receiving banknotes through a receiving slot provided in said banknote receiving cassette, said cassette receiving frame including a guide for slidably receiving said cassette for movement to a stop position determining said aligned position and a magnetic latch formed between said cassette receiving frame and said banknote cassette providing a manually breakable magnetic force maintaining said cassette in said aligned position and allowing a user to break said magnetic force by withdrawing said banknote cassette; wherein said magnetic latch is defined by a permanent magnet and a magnetic material with said permanent magnet secured to one of said banknote cassette or said cassette receiving frame and cooperating with said magnetic material provided as part of a surface of the banknote cassette or cassette receiving frame opposed to said permanent magnet; and including spacer members on opposite sides of said permanent magnet extending beyond said permanent magnet to contact said banknote cassette and space said banknote cassette a predetermined distance from said permanent magnetic to limit the magnet force.

2. In combination as claimed in claim 1 wherein said magnetic latch provides suffident force to move said cassette to said aligned position when generally received in said cassette receiving frame.

3. In combination, as claimed in claim 1 wherein said permanent magnet is part of said cassette receiving frame.

4. In combination as claimed in claim 3 wherein said magnetic material is part of a metal wall of said banknote cassette that faces and is engaged by said permanent magnet when said banknote cassette is inserted in said cassette receiving frame.

5. In combination as claimed in claim 4 wherein said permanent magnet is positioned to attract a central portion on a rear surface of said banknote cassette.

* * * * *